US009375383B1

(12) United States Patent
Wang

(10) Patent No.: US 9,375,383 B1
(45) Date of Patent: Jun. 28, 2016

(54) MEDICINE BOX

(71) Applicant: Jonathan Wang, Hayward, CA (US)

(72) Inventor: Jonathan Wang, Hayward, CA (US)

( * ) Notice: Subject to any disclaimer, the term of this patent is extended or adjusted under 35 U.S.C. 154(b) by 0 days.

(21) Appl. No.: 14/742,260

(22) Filed: Jun. 17, 2015

(51) Int. Cl.
*A61J 1/00* (2006.01)

(52) U.S. Cl.
CPC ..... *A61J 1/00* (2013.01)

(58) Field of Classification Search
CPC ..... A61J 1/03; A61F 15/001; B65D 83/42
USPC ..... 206/438, 528, 229, 1.5; 220/345.3; 221/246, 289
See application file for complete search history.

(56) References Cited

U.S. PATENT DOCUMENTS 1,450,674 A * 4/1923 Marston ..... A45C 7/0031 131/242
1,997,043 A * 4/1935 Clark ..... A24F 15/18 131/242
3,159,308 A * 12/1964 Passavanti ..... B65D 83/0409 221/190
4,483,095 A * 11/1984 Webinger ..... A01M 1/02 206/525
4,561,544 A * 12/1985 Reeve ..... B65D 11/12 206/1.5
4,893,728 A * 1/1990 Jennings ..... B65D 47/263 221/306
4,946,057 A * 8/1990 Connolly ..... B65D 43/12 206/45.28
5,082,137 A * 1/1992 Weinstein ..... B65D 43/20 206/1.5
5,099,999 A * 3/1992 Balien ..... B65D 83/0481 206/536
5,141,129 A * 8/1992 Jennings ..... B65D 50/061 206/536
5,275,291 A * 1/1994 Sledge ..... B65D 43/20 206/1.5
5,405,011 A * 4/1995 Haber ..... B65D 83/0463 206/531
5,415,315 A * 5/1995 Ramirez ..... B65F 1/1607 206/366
5,480,249 A * 1/1996 Kageyama ..... B65D 83/02 206/214
5,562,212 A * 10/1996 Rosler ..... B65D 85/20 206/379
6,953,131 B2 * 10/2005 Devine ..... B65D 83/0409 221/246
7,004,312 B2 * 2/2006 Chen ..... A45C 11/18 206/232
7,677,389 B2 * 3/2010 Czopor, Jr. ..... B65D 5/54 206/340
7,757,843 B2 * 7/2010 Katsis ..... A24F 27/00 206/1.5
8,123,037 B2 * 2/2012 Lee ..... B65D 83/04 206/536
8,281,930 B2 * 10/2012 Lee ..... B65D 83/04 206/536
8,359,816 B2 * 1/2013 Guschke ..... A61J 1/03 53/170
8,458,994 B2 * 6/2013 Guschke ..... A61J 1/03 53/415
2011/0000814 A1 * 1/2011 Lee ..... B65D 83/04 206/528
2011/0289884 A1 * 12/2011 Guschke ..... A61J 1/03 53/411
2013/0000258 A1 * 1/2013 Guschke ..... A61J 1/03 53/467
2013/0255198 A1 * 10/2013 Guschke ..... A61J 1/03 53/467
2013/0320017 A1 * 12/2013 Kientzle ..... A61J 1/03 220/345.3

* cited by examiner

*Primary Examiner* — Steven A. Reynolds
*Assistant Examiner* — King M Chu
(74) *Attorney, Agent, or Firm* — Maier & Maier, PLLC

(57) ABSTRACT

A medicine box including a casing with a mouth, and a box cover. One or more sides of the mouth are set with resilient snaps and one or more sides of the box cover have conjunction holes. One side of the box cover has a medicine hole, the medicine hole is blocked by the cover when in a sealed position. To remove medicine from the casing, the resilient snap is pressed to separate from the conjunction hole. The box cover can then freely slide up and down the mouth to expose the medicine hole and remove medicine from the medicine box. After taking out the medicine, the box cover may slide downward to buckle the resilient snap into the conjunction hole, firmly fixing the box cover on the mouth.

7 Claims, 6 Drawing Sheets

MEDICINE BOX

TECHNICAL FIELD

This utility model may involve the storage container technology, for example, medicine boxes.

BACKGROUND

A typical medicine box generally has one or more drug grids for the users to store medicine according to the dosage, thus facilitating carrying and medicine taking. In existing medicine boxes, the casing has a mouth on the top, and a cover on the mouth, with the medicine in the casing. When taking out the medicine, the box is opened entirely and the medicine is removed. Because of the large mouth, excess medicine above the prescribed dosage may be dispended from the box, and therefore need to be put back. This practice can lead to contamination of the medicine in the box.

SUMMARY

A medicine box having a casing with a mouth on a top portion, and a box cover covering the mouth. A resilient snap is provided on at least one side of the mouth, and a conjunction hole corresponding to the resilient snap is provided on at least one side of the box cover. A medicine hole is located above the conjunction hole, and is accessible when the conjunction hole is disengaged from the resilient snap, and the box cover is raised relative to the mouth.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
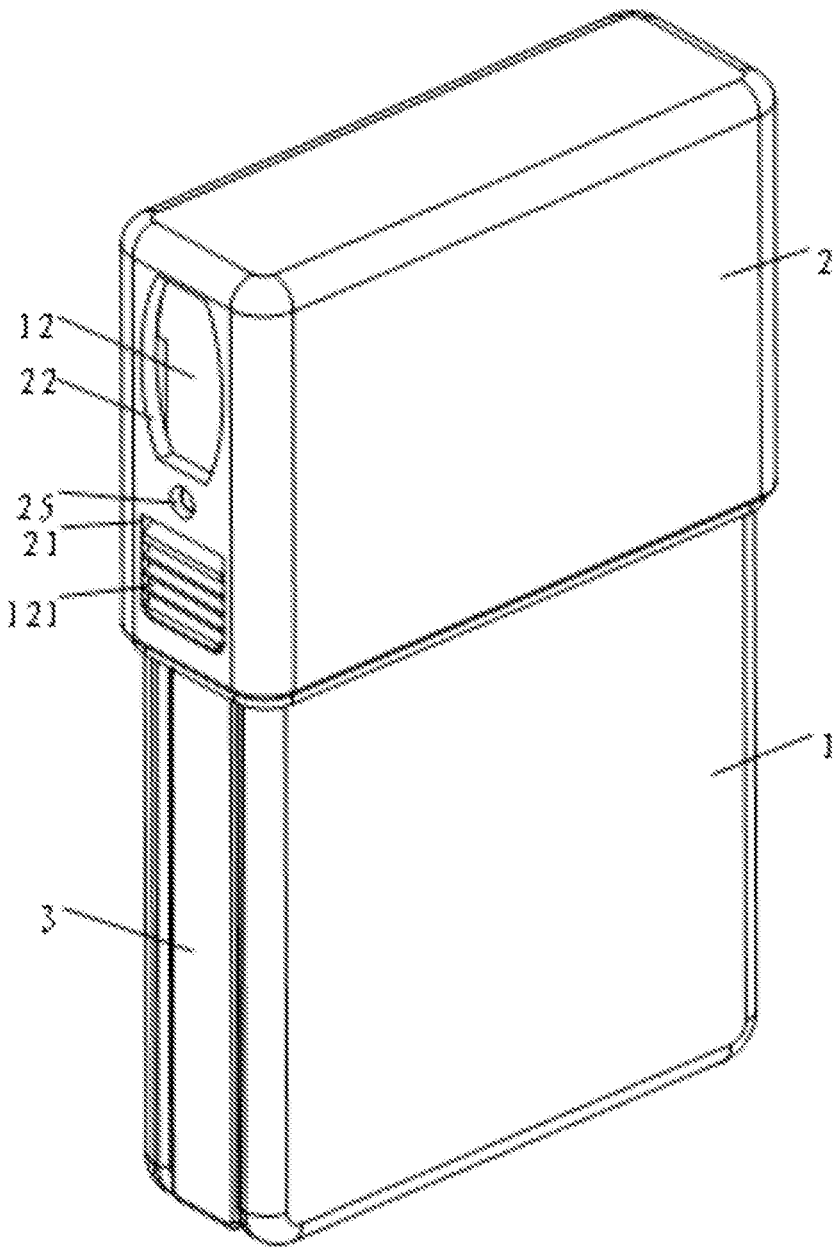
FIG. 1 is the schematic diagram of the utility model.
Figure 2:
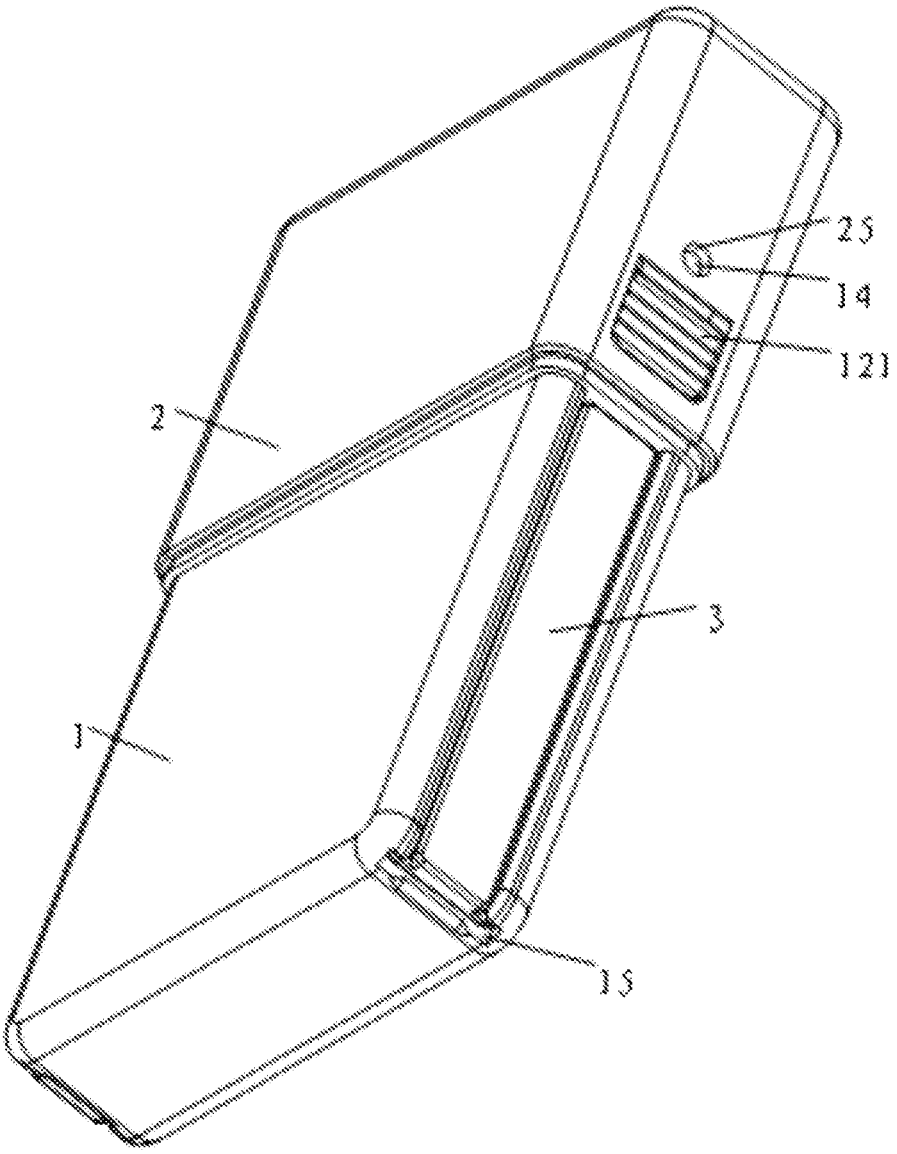
FIG. 2 is the schematic diagram of the utility modern from another perspective.
Figure 3:
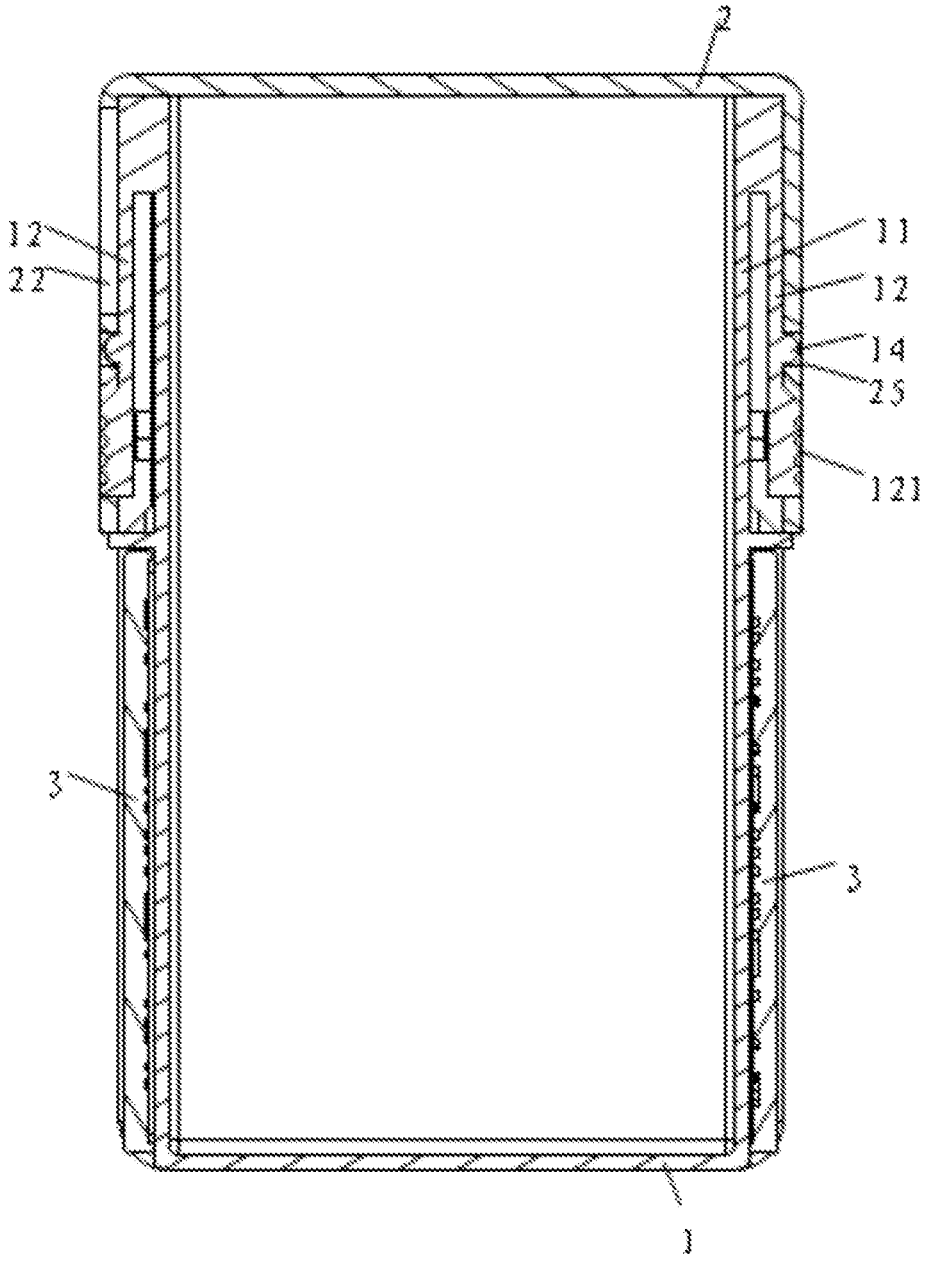
FIG. 3 is the cross-sectional illustration of the utility model.
Figure 4:
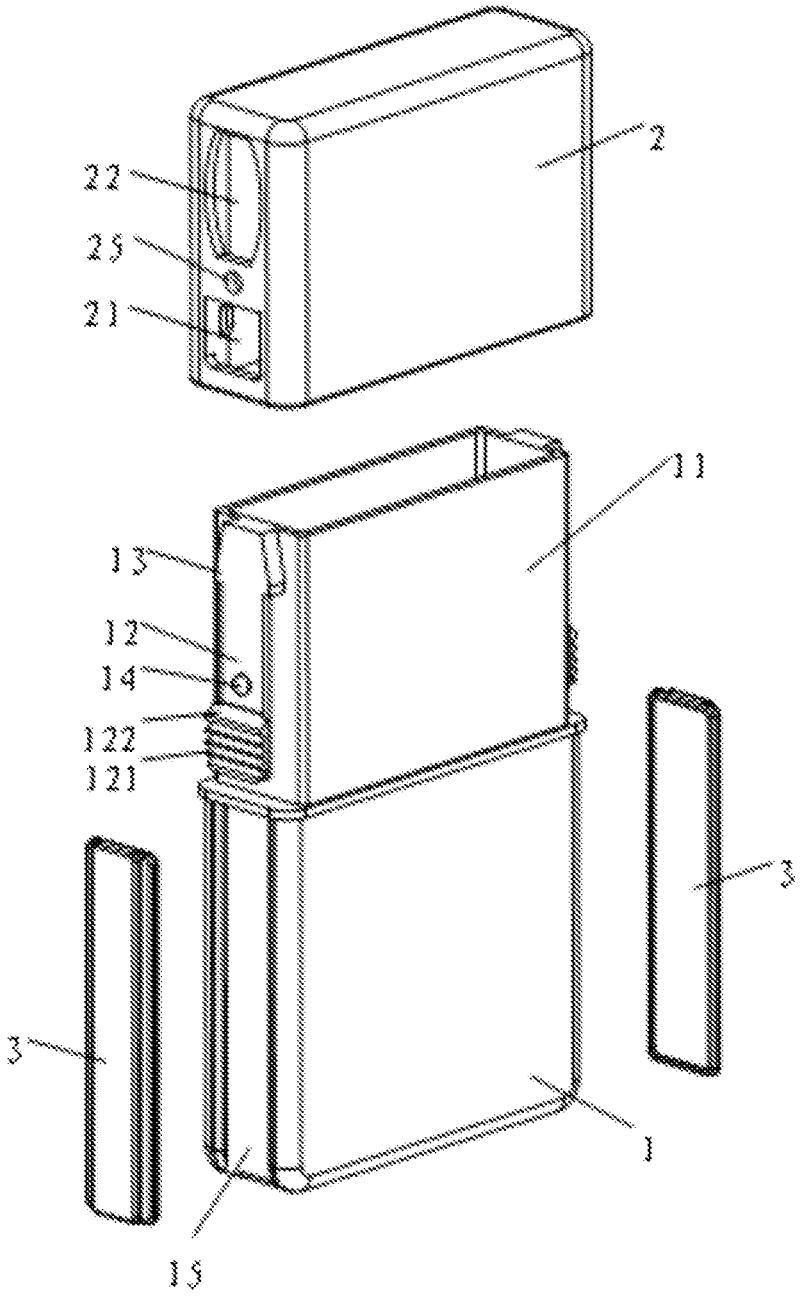
FIG. 4 is the exploded view of the utility model.
Figure 5:
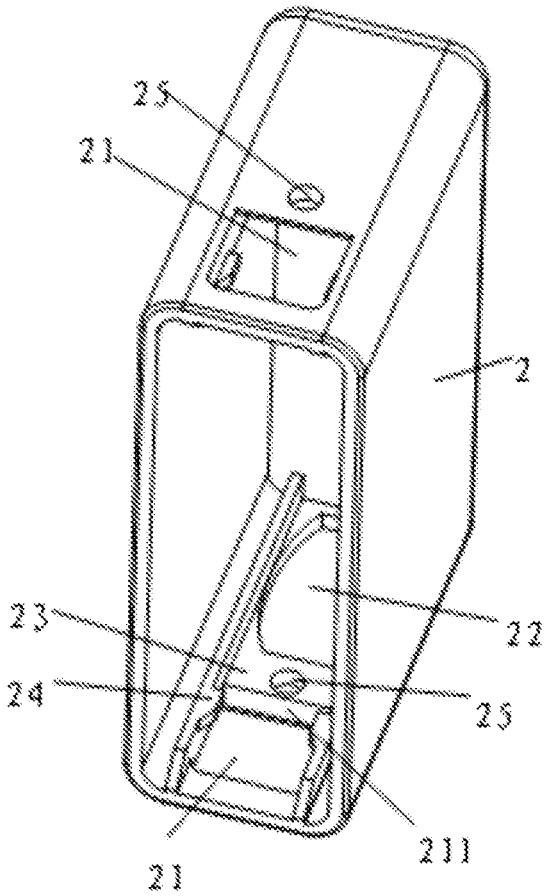
FIG. 5 is the schematic diagram of the utility model.
Figure 6:
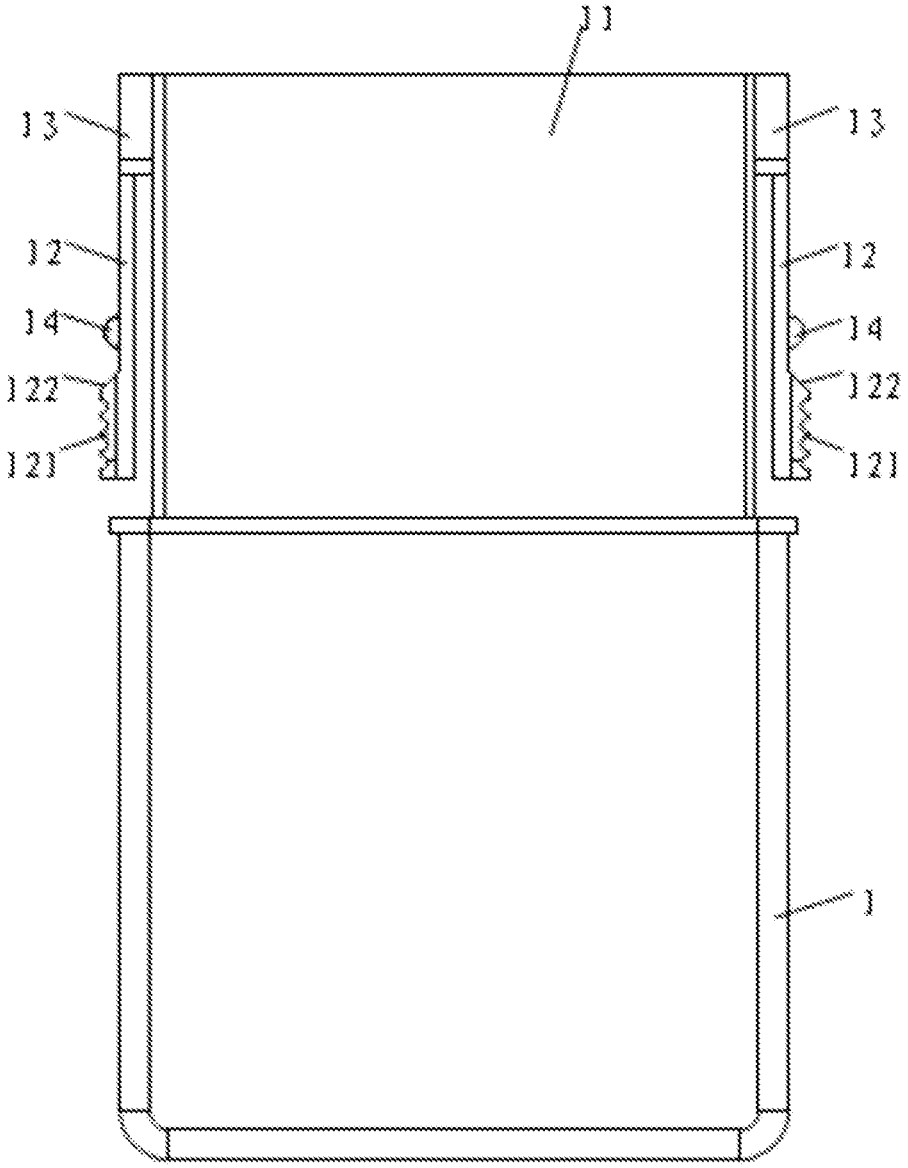
FIG. 6 is the box schematic diagram of the utility model.

Referring generally to FIGS. 1-6, in a first exemplary embodiment, the box may include casing 1 with box mouth 11, with cover 2 set on the mouth 11. On or more sides of the box mouth 11 may have a resilient snap 12, and one or more sides of the cover 2 may have a conjunction hole 21 for engaging the resilient snap 12. One side of the box cover 2 may have a medicine hole 22 for dispensing the medicine above the conjunction hole 21.

The top of the resilient snap 12 may extend upward and may be fixed on the box mouth 11 near the top to form a cantilever type structure, which may provide the resilient snap 12 with good elasticity and convenient operation. One or more internal sides of the box cover 2 may include an open vertical chute 23. Each resilient snap 12 may correspond to a respective open vertical chute 23 to facilitate opening the cover 2 upwards or downwards.

A protruding part of the front and rear sides on the top of resilient snap 12 may have a barb 13. A portion of chute 23 proximate the bottom may have a hook 24 which can engage the barb 13. The cooperation between the bard 13 and hook 24 can, for example, restrain the resilient snap 12 from sliding in the chute 23. In one exemplary embodiment, when the cover 2 slides upwards to the top of the mouth 11, the internal hook 24 may be buckled by the barb 13, which may limit further upward movement, thus preventing the separation between cover 2 and casing 1.

One or more sides of the box cover 2 may have a positioning hole 25. Resilient snap 12 may have a positioning column 14 in correspondence with the positioning hole 25. In one exemplary embodiment, the positioning column 14 may be inserted in the corresponding positioning hole 25. The positioning column 14 may further lock the cover 2 and casing 1 after the resilient snap 12 engages the conjunction hole 21. The cooperation between positioning column 14 and positioning hole 25 together with the cooperation between resilient snap 12 and conjunction hole 21 can, for example, prevent children from opening the cover 2.

A bottom of the resilient snap 12 may have a pressing portion 121 protruding therefrom. The pressing portion 121 may correspond with the conjunction hole 21. In some exemplary embodiments, the pressing portion 121 may be in the corresponding conjunction hole 21 and the top of the pressing portion 121 may form a first inclined surface 122. In further exemplary embodiments, as the box cover 2 moves downward on box mouth 11, the pressing portion 121 and the first inclined surface 122 may be contacted such that the resilient snap 12 may have inward deformation under the role of the first inclined surface 122 to make the pressing portion 121 automatically lock in the conjunction hole 21. The operation may be simple and convenient. In some exemplary embodiments, an upper edge of the conjunction hole 21 may form a second inclined face 211 which may correspond with and engage the first inclined surface 122.

One or more sides of the casing 1 may have a slot 15, with a tag plate 3 matching the slot 15. Both slot 15 and tag plate 3 may form a T-structure. The tag plate 3 may be marked with drug information, medication instructions, trademark information, manufacturer information, or other information as would be understood by a person of ordinary skill in the art. In addition, the tag plate 3 can be easily replaced and another tag plate 3 with different information can be provided in slot 15.

In one exemplary embodiment, when the box cover 2 fully engages the mouth 11, the medicine box may be in a sealed position such that the medicine hole 22 may be blocked by an outer surface of mouth 11. To remove medicine from an interior of the casing 1, the resilient snap 12 on mouth 11 may be pressed inward to separate or otherwise disengage resilient snap 12 from the conjunction hole 21 of cover 2. At this point, the cover 2 may freely slide up and down relative to mouth 11. When the cover 2 slides upward a certain distance, mouth 11 may be exposed such that the interior of casing 1 is in communication with medicine hole 22. Medicine may be removed from the interior of casing 1 through medicine hole 22. After removing the medicine, the cover 2 may be moved downward to re-engage or buckle the resilient snap 12 into the conjunction hole 21, thus making the cover 2 firmly fixed on the mouth 11. Thus, when removing medicine, the cover 2 may not be completely removed from casing 1. Rather, medicine may be removed through medicine hole 22. In this way, the medicine quantity can easily be controlled which may prevent contamination.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

The invention claimed is:

1. A medicine box, comprising:

a casing with a mouth on the top;

a box cover configured to cover the mouth;

a resilient snap on at least one side of the mouth;

a conjunction hole corresponding to the resilient snap on at least one side of the box cover;

a medicine hole on the box cover located above the conjunction hole;

at least one open vertical chute on an interior side of the box cover configured to receive the resilient snap;

a barb protruding from at least one side of the resilient snap; and a hook proximate a bottom of the at least one vertical chute and configured to engage the barb.

2. The medicine box according to claim 1, wherein a top portion of the resilient snap is cantilevered and fixed on the mouth.

3. The medicine box according to claim 1, further comprising:

a positioning hole on the at least one side of the box cover; and a positioning column on the resilient snap corresponding to the positioning hole, wherein the positioning column is configured to be inserted into the positioning hole.

4. The medicine box according to claim 1, further comprising:

a pressing portion on a bottom of the resilient snap corresponding to the conjunction hole; and a first inclined surface on a top of the pressing portion.

5. The medicine box according to claim 4, wherein an upper edge of the conjunction hole forms a second inclined surface corresponding to the first inclined surface.

6. The medicine box according to claim 1, further comprising:

a slot on at least one side of the casing, the slot having a tag plate configured to insert into the slot.

7. The medicine box according to claim 6, wherein the slot and tag plate form a T-structure.

* * * * *